United States Patent [19]

Thomas

[11] Patent Number: 4,988,303

[45] Date of Patent: Jan. 29, 1991

[54] ADJUSTABLE AGITATOR ASSEMBLY

[76] Inventor: William K. Thomas, N 11897 Deerlake, Tomahawk, Wis. 54487

[21] Appl. No.: 299,207

[22] Filed: Jan. 23, 1989

[51] Int. Cl.[5] ..... B01F 5/10; B01F 5/12; B01F 7/04; B01F 7/22

[52] U.S. Cl. ..... 366/285; 366/326; 366/330; 366/331; 366/343; 416/205

[58] Field of Search ..... 366/285, 286, 325, 326, 366/330, 331, 342, 343, 270; 416/205, 207, 204 R

[56] References Cited

U.S. PATENT DOCUMENTS

| | | | |
|---|---|---|---|
| 705,866 | 7/1902 | Punzelt | 416/207 |
| 794,010 | 7/1905 | Hayden | 416/207 |
| 1,483,551 | 2/1924 | Mosher . | |
| 1,634,330 | 7/1927 | Malm . | |
| 1,745,595 | 2/1930 | Altorfer . | |
| 1,812,831 | 6/1931 | Parsons . | |
| 2,228,524 | 1/1941 | Lampton | 416/207 |
| 2,372,714 | 4/1945 | Effinger, Jr. . | |
| 2,563,011 | 4/1951 | Dehnicke . | |
| 2,636,720 | 4/1953 | Forrest . | |
| 2,641,984 | 6/1953 | Hall . | |
| 2,844,207 | 7/1958 | Curley | 416/207 |
| 3,077,228 | 2/1963 | Mohn . | |
| 3,452,820 | 7/1969 | Philipsen et al. | 416/205 |
| 3,744,927 | 7/1973 | Bernaerts | 416/205 |
| 3,790,304 | 2/1974 | Langlois | 416/207 |
| 4,150,921 | 4/1979 | Wennberg et al. . | |
| 4,304,494 | 12/1981 | Lutz . | |
| 4,456,382 | 6/1984 | Mahler, II . | |
| 4,722,608 | 2/1988 | Salzman et al. | 366/343 |
| 4,799,862 | 1/1989 | Davidson et al. | 366/330 |
| 4,802,771 | 2/1989 | Weetman | 366/270 |

FOREIGN PATENT DOCUMENTS

| | | | |
|---|---|---|---|
| 903792 | 8/1962 | United Kingdom | 416/205 |

*Primary Examiner*—Timothy F. Simone
*Attorney, Agent, or Firm*—Wheeler Law Firm

[57] ABSTRACT

An adjustable agitator assembly having a hexagonal shaft to which is attached a hexagonal hub. A mounting block is attached to the hub at the desired locations. The mounting block has a receptacle to receive the splined shaft of a paddle. The splines allow the orientation of the paddle to be changed to many different discrete positions while at the same time preventing the paddle shaft from slipping. Seals are used to prevent penetration of the contacts between the various parts of the assembly by the media which is stirred.

5 Claims, 1 Drawing Sheet

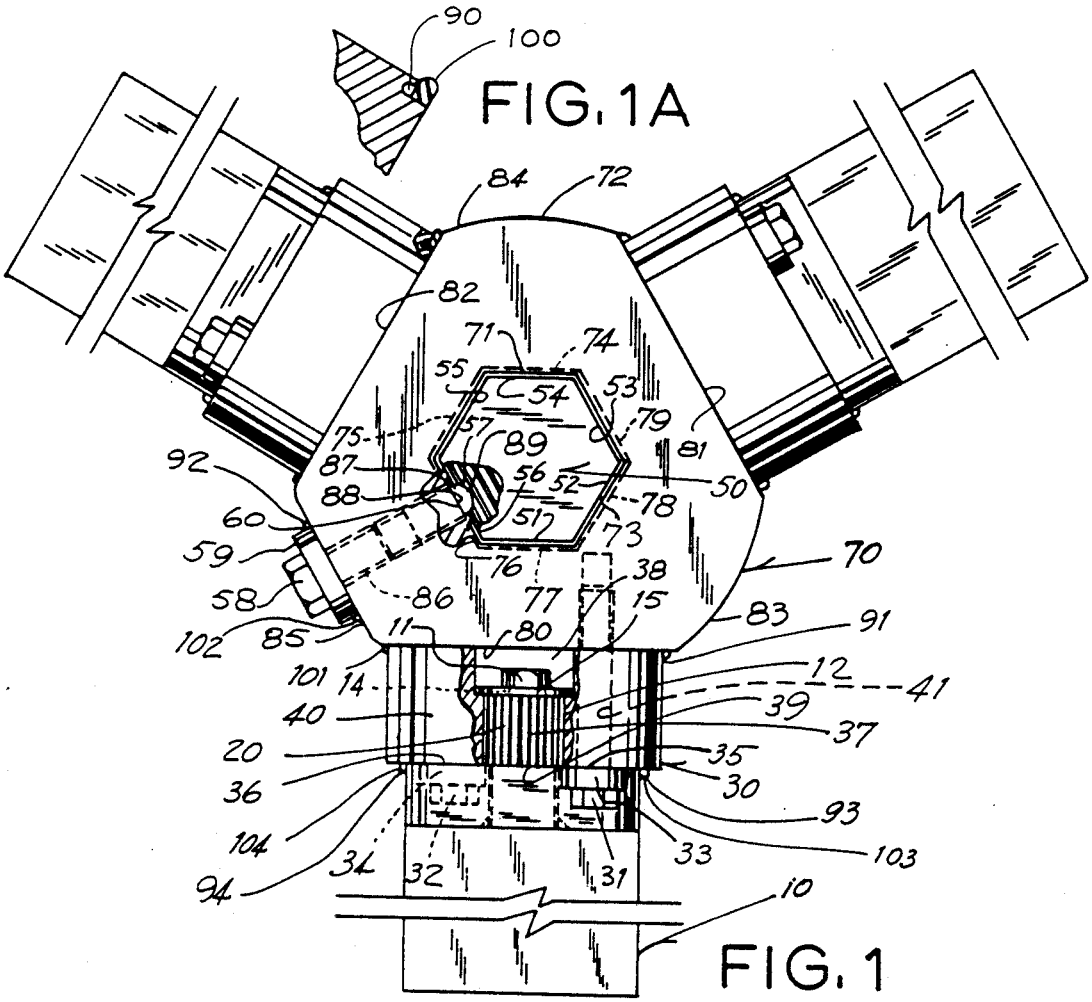
FIG. 1A
FIG. 1
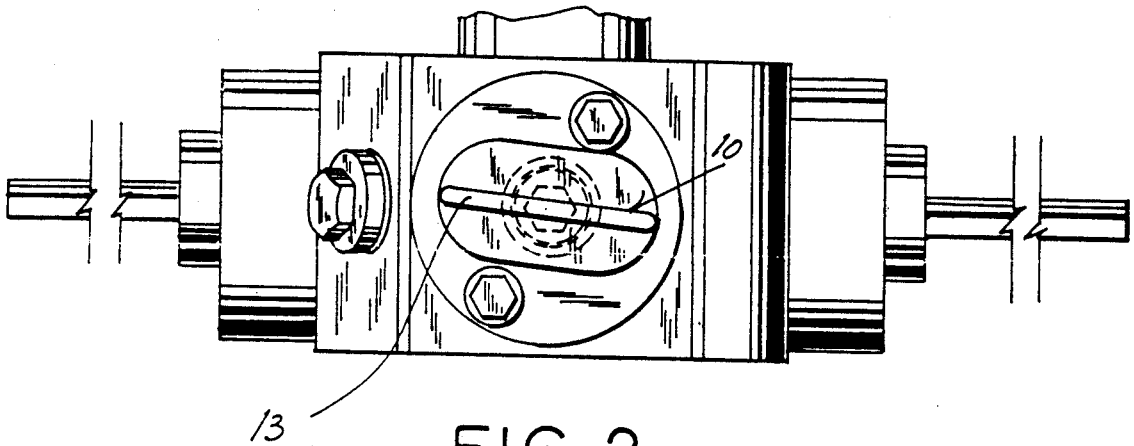
FIG. 2

ADJUSTABLE AGITATOR ASSEMBLY

BACKGROUND OF THE INVENTION

The present invention relates to the field of tank agitators. The type of agitation used in a tank determines the type of result achieved. To vary the agitation it is desirable, in addition to varying the drive power and ratio driving the blade shafts, to vary the pitch of the agitator blades. The pitch affects the speed and power absorption, and interacts with motor power and drive ratio.

Whether it is used in the preparation of food, a chemical or other processess the orientation of the agitator blades directly impacts upon the type of product and quality of product produced within the tank. Therefore, it is desirable that the position of the agitator used be variable so that the product can be produced with maximum efficiency.

Traditionally, changing the position or pitch of an agitator blade has been a time consuming process. There have been many attempts to make this simpler. For example, (Mahler), U.S. Pat. No. 4,456,382 shows an agitator hub that is designed to be used in an agitation tank just as the present invention is to used. However, the Mahler patent is structurally very different from the instant invention. The Mahler patent discloses a round shaft to which a hub in two pieces is affixed. The hub and central shaft are held to each other by use of a locking bolt. The two pieces of the hub are designed to slide vertically up and down the shaft. There is a recess or opening that is formed by the combination of the two pieces of the hub. Into this opening the shaft of the paddle that is used is placed. The shaft of the paddle is held in whatever desired position by the pressure of the two pieces of the hub which are clamped around the paddle shaft. The connection of the central shaft and the hub could slip. For example the central shaft could rotate, despite the locking bolt, with respect to the hub. The paddle could rotate or slip with respect to the hub. The present invention is designed in such a manner that is impossible for the hub to slip with respect to the shaft and it is impossible for the shaft of the paddle to slip with respect to the hub. Furthermore, the hub is not two separate pieces but one piece. Also, the Mahler patent does not disclose the use of seals to aid in keeping the machine clean and sanitary.

Another patent, (Altofer), U.S. Pat. No. 1,745,595 shows a radically different type of stirrer than that which is contemplated in the invention. The stirrer shown is somewhat adjustable in position because of the fact that the shaft 2 at the bottom of FIG. 1 (as disclosed in the patent) is square in cross section. The same is true of the shaft 13. However, this is not a practical adjustment and is not the type of adjustment contemplated by the applicant's invention. (Parsons), U.S. Pat. No. 1,812,831 shows adjustment of the blade of an aircraft propeller. Again, both the mechanical construction and the purpose are different from the applicant's invention. (Forest), U.S. Pat. No. 2,636,721 is somewhat closer to the applicant's invention but the impellers of the Forest patent are mounted on hubs that are shaped like pinion gears and are captured inside of a bolt-together housing. By unbolting the housing the angle of the impeller can be changed. Again this is not similar in mechanical construction or purpose to the applicant's invention. Also, it would appear that sealing and cleaning the Forest patent would be a serious problem if it was used in a structure that required cleaning; for instance, a food or chemical agitator tank. The same can be said of (Hall) U.S. Pat. No. 2,641,984. The Hall patent is not intended to stir food products or chemicals, only earth. (Mohn), U.S. Pat. No. 3,077,228 is cited because it uses set screws to effect an adjustment but the purpose, structure and function of the Mohn patent is different from that of the applicant's invention. (Lutz), U.S. Pat. No. 4,304,494 does show an adjustable paddle but the concept and structure are completely different from the applicant's invention as Lutz discloses a slip-on shroud to protect the shank of a mixing paddle of an asphalt mixer. A simple examination of the drawings of the Lutz patent, as well as the claims, show how radically different it is from the present invention. (H. Malm), U.S. Pat. No. 1,634,330 discloses a marine propeller with means for adjusting the pitch of the blades. However, the shaft to which the hub of the Malm invention is attached must be round and no method for sealing the connections between the blades, the hub, and the shaft is disclosed. Therefore, cleaning and maintaining the Malm propeller in connection with processing of food would be much harder than with the applicant's invention. Also the structure of the Malm invention is different from the applicant's invention. (W. L. Effinger, Jr.), U.S. Pat. No. 3,272,714 discloses an adjustable propeller that is adapted for use in model airplanes. The blades are held in the hub by frictional means. The invention is structurally different from the applicant's invention and does not have the same proposed use. (A. E. Dehnicke), U.S. Pat. No. 2,563,011 discloses a two-part hub adjustable pitch fan for use in an automobile engine. The adjustment of one blade of this fan will adjust all the other blades of this fan. Furthermore, the structure of the Dehnicke invention is different from that of the applicant's invention. Also, since the adjustment of one blade would adjust all blades in the Dehnicke invention it would not meet the requirements of the applicant's invention since it may be necessary to have the blades in the applicant's invention be of differing pitches or two of the same pitch and one of a different pitch, etc. This would not be possible with the Dehnicke invention. (Wennberg et al), U.S. Pat. No. 4,150,921 discloses marine propellers that are constructed with a split-hub design. The propellers are screwed into the hub which is completely different in concept and structure from the applicant's invention. Also, the purpose of the Wennberg patent is not the purpose of the applicant's invention.

None of the above prior art known to the inventor teach a structure that wouold suggest applicant's invention. The closest reference is believed to be the Mahler patent and the applicant's invention is significantly different from that patent in structure. The inventor knows of no other prior art that is closer to his invention than the Mahler patent.

Other advantages and features, as well as objects, of the invention will become apparent from the ensuing description of a preferred embodiment, taken with reference to the appended drawings.

SUMMARY OF THE INVENTION

This invention is comprised of a central shaft, a hub, a mounting block, paddle shafts, and paddles. In this invention both the central shaft and the hub on which the paddles are mounted are hexagonal. The hub is desirably held to the central shaft by a set screw which enters a recess drilled in an central shaft at the appropriate location. In this way the hub is keyed to the shaft and cannot move up or down. The fact that the shaft and the opening in the shaft are hexagonal prevents any rotation of the hub with respect to the shaft.

Alternate faces of the hexagonal hub receive a circular paddle base or mounting block which is bolted to the hub and has a central hole which is splined. Mounted on the mounting block is an oval paddle having a base which is a larger oval to which is welded a splined shaft matching the splined opening in the mounting block. The reverse side of the mounting block is provided with a recess larger than the splined opening through the mounting block. A bolt with its head in the recess extending through the mounting block into the splined shaft secures the paddle to the mounting block.

The mounting block fits onto the hub in only two orientations which are 180 degrees apart. Thus, the orientation which is selected does not alter the position of the symmetrical paddle. However the position of the paddle may be changed quite easily by removing the bolt at the center of the mounting block from the end of the splined shaft which is part of the paddle. The splined shaft may then be rotated to any position in which the teeth of the shaft match the teeth of the splined opening in the mounting block and reinserted, after which it is bolted into place. The mounting block is then rebolted to the hub.

Each of the mating surfaces is provided with a channel for a seal ring. In this way the contents of the container which are to be stirred cannot get between the parts of the agitator and the parts of the agitator are therefore easily cleaned.

Because the angle of each paddle can readily be adjusted the system described gives a great deal of control over the amount of movement of the contents of the tank at a particular speed of rotation of the shaft. In addition, speed and power absorption are readily matched to drive power and drive speed ratio. The structure is much more sanitary and easily cleaned. Finally, although a great deal of power may be applied to the shaft it is exceedingly unlikely that the hub for the paddles will slip because in addition to the set screw and key there is a non-circular shaft in a non-circular hole, and the paddles are positively held by a splined connection (rather than relying on clamping force against the circular connection). The spines are easily kept clean because they are protected from contamination by the seal rings.

In this application the word "agitate" is used to mean, in addition to its dictionary meaning, to move back and forth or in one direction; the movement does not have to be a violent one.

DESCRIPTION OF THE DRAWINGS

FIG. 1 is a top plan view of the adjustable agitator assembly.

FIG. 1*a* is a close up view showing the sealed connection between the mounting block and the hub.

FIG. 2 is a side elevational view of the adjustable agitator assembly.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

As illustrated in the drawings the present invention is comprised of a paddle assembly 10, a mounting block 30, a central shaft 50, and a hub 70. The paddle assembly 10 is attached to the mounting block 30 which in turn is attached to the hub 70 which in turn is attached to the shaft 50. Both the hub 70 and shaft 50 are hexagonal in shape. At each point of attachment between each piece of the present invention there is a groove 90–94 and in each groove there is a seal 100–104. The seals prevent the penetration of the tank media, for instance food, into the connections between the parts of the invention thereby making the invention easier to clean. For example, the connection between the hub 70 and the mounting block 30 sealed by seal 100 in groove 91. A close up view showing the relationship of the seals and grooves generally and the relationship between seal 100 and groove 90 specifically may be seen in FIG. 1*a*.

As illustrated in the figures, the paddle 10 is comprised of a bolt 11, a splined shaft 12, a blade 13, an opening 14, and a washer 15. Also illustrated in FIG. 1 is the mounting block 30. The mounting block 30 is comprised of two bolts 31 and 32, two washers 33 and 34, two openings 35 and 36 (opening 35 is not shown), a splined receptacle 37, a gap 38, and an opening 39.

The paddle assembly 10 is connected to the mounting block 30 by the bolt 11. The spined shaft 12 is placed in the splined receptacle 37. Opening 39 is at the base of the splined receptacle 37. The opening 39 faces the gap 38 that is between the mounting block 30 and the hub 70. The opening 14 of the paddle 10 is located at the end of the splined shaft 12 that is placed into the splined receptacle 37. The opening 14 is in direct alignment with the opening 39. The washer 15 is placed on the bolt 11. The bolt 11 is then screwed into the opening 14 in the end of the splined shaft 12 through the opening 39 of the mounting block 30 thereby securing the paddle assembly 10 to the mounting block 30. There is no need for a seal around the end of bolt 11 and washer 15 because they are contained within the gap 38 which is inside the mounting block 30 and sealed by seal 101 in groove 91.

The mounting block 30 is connected to the hub 70. The hub 70 is of the general shape of a hexagonal donut. The hub 70 has a hexagon shaped inside surface 71 that forms a hexagon shaped opening 73 and a hexagonally shaped outside surface 72. The inside surface 71 of the hub 70 is comprised of six equal walls 74–79. The outside surface 72 is comprised of three long walls 80–82 and three short walls 83–85. Inside wall 76 of the inside surface 71 contains opening 86.

The opening 86 passes through the hub 70 connecting inside wall 76 with outside wall 85 of the hexagonally shaped outside surface 72. Contained within the opening 86 is a D-shaped key 87. The key 87 is comprised of one-half of a circle having a flat side 88 and a curved side 89.

The shaft 50 is also hexagonal shaped and has six equal sides 51 through 56. The shaft 50 fits through the hexagon shaped opening 73 of the hub 70. The shaft 50 has a side 56 that contains a key-way 57. The hub 70 is placed on the shaft 50 and slide down the shaft 50 until the key-way 57 and the opening 86 are in alignment. A bolt 58 is then placed into the opening 86 through the outside wall 85 of the hub 70. A washer 59 is also used to insure a tight seal around connection between the head of the bolt 58 and the outside wall 85 of the hub 70. The connection between the washer 59 and the outside wall 85 is sealed by seal 102 in groove 92. The bolt 58 is screwed into the opening 86 until the flat end 60 of the bolt 58 comes into contact with the flat side 88 of the key 87. The bolt 58 is continued to be screwed in, pushing the curved side 89 of the key 87 into key-way 57 of side 56 of the shaft 50. This causes the hub to be securely mounted to the shaft 50.

The mounting block 30 is attached to the hub 70 on one of the three long walls 80–82 by using bolts 31 and 32. For example, wall 80 contains two receptacles 40 and 41 for bolts. Openings 35 and 36 of the mounting block 30 allow bolts 31 and 32 to pass through them. Openings 33 and 34 are in alignment with receptacles 40 and 41 of the hub wall 80. Washers 33 and 34 are placed over the bolts 31 and 32 respectively. The bolts 35 and 36, are then passed through the openings 35 and 36 respectively, and screwed into the receptacles 40 and 41 of the hub wall 80 thereby securing the mounting block 30 to the hub 70. The connections between the washers 33 and 34 and the mounting block 30 are sealed by seals 103 and 104 in grooves 93 and 94, respectively.

The resulting agitator assembly may be easily taken apart and the position of the blade 13 may be easily changed to another predetermined position by removing the splined shaft 12 from the spined receptacle 37 and rotating the blade 13 to the desired position. The splines 20 of the shaft 12 and the splines 21 of the receptacle 37 greatly strengthen the connection between the paddle 10 and the mounting block 30. The two groups of splines 20 and 21 prevent slippage of the blade 13 during the agitation process. Whereas, a smooth shaft using set screws to maintain its position could slip and thereby change the position of the blade 13.

The above described embodiments of this invention are merely descriptive of its principles and are not to be limiting. The scope of this invention instead shall be determined from the scope of the following claims, including their equivalents.

What is claimed is:

1. A liquid agitator assembly for agitating liquid comprising:

paddle means having at least one stirring surface and an end having paddle mounting means;

a noncylindrical rotatable shaft to move said paddle means;

said noncylindrical rotatable shaft having removable mounting means for said paddle means, comprising a solid single piece hub having an opening complementary to the shape of said rotatable shaft and at least one mounting receptacle having internal cavity adapted to receive and interlock with said paddle mounting means in any of a series of fixed preselected positions;

a plurality of fastening means securing said removable mounting means to said noncylindrical shaft;

said paddle mounting means of said paddle means also being attached by at least one said fastening means to said rotatable shaft at said removable mounting means so that said stirring surface is at a preselected position;

said paddle mounting means, said hub, and said removable mounting means having smooth surfaces and resilient seals along their joints with each other to exclude liquids to permit easy cleaning.

2. The device of claim 1 in which said substantially noncircular shaft contains a key way;

said hub has an outside wall and an inside wall;

said hub having an opening running through it from said outside wall to said inside wall;

said opening containing a key;

said opening being in alignment with said key way;

at least one said fastening means used to push one end of said key into said key way;

at least one said fastening means holding said end of said key in said key way; whereby said hub is firmly secured to said substantially noncylindrical shaft.

3. A liquid agitator assembly for agitating liquid comprising:

paddle means having at least one stirring surface and an end having paddle mounting means;

a noncylindrical rotatable shaft to move said paddle means;

said noncylindrical rotatable shaft having removable mounting means, comprising a single piece hub with a shaft opening complementary to said shaft and at least one mounting receptacle, adapted to internally receive and interlock with said paddle mounting means in any of a series of fixed preselected positions;

a plurality of sealing means for sanitary sealing;

a plurality of recessed seal channel means for receiving said sealing means along the joints between said mounting means, said hub, and said receptacle;

a plurality of fastening means substantially securing said removable mounting means to said noncylindrical shaft;

said paddle mounting means of said paddle means also being attached by at least one said fastening means to said mounting receptacle so that said stirring surface is at a preselected position.

4. A fluid agitator assembly comprising:

paddle means having at least one stirring surface and an end having paddle mounting means;

a plurality fastening means;

a rotatable shaft to move said paddle means;

said shaft having mounting means adapted to receive said paddle mounting means in any of a series of fixed pre-selected positions;

said paddle mounting means of said paddle means being attached by at least one said fastening means to said rotatable shaft at said mounting means at said fixed preselected position;

said rotatable shaft being non-cylindrical in shape;

said mounting means being a generally circular block and a hub having an opening complimentary to said shaft;

said paddle mounting means having a splined shaft;

said block having a splined receptacle;

said paddle having a splined end and a paddle end;

said splined end fitting into said receptacle;

said hub being hexagonal in shape;

said block being attached to said hub by at least one said fastening means;

said paddle being attached to said shaft by at least one said fastening means;

the connections between said shaft, said hub, said block, said paddle, and said fastening means having grooves;

said grooves being capable of holding seals;

said seals sealing said connections between said shaft, said hub, said block, said paddle, and said fastening means.

5. A fluid agitator assembly comprising:

paddle means having at least one stirring surface and an end having paddle mounting means;

a plurality of fastening means;

a rotatable shaft to move said paddle means;

said shaft having mounting means, comprising a single piece hub and at least one mounting receptacle, adapted to receive said paddle mounting means in any of a series of fixed pre-selected positions;

said paddle mounting means of said paddle means being attached by at least one said fastening means to said rotatable shaft at said mounting means at said pre-selected position;

said rotatable shaft being generally non-circular in shape;

said shaft having a top, bottom and six equal sides;

said hub having a center opening and an outside;

said center opening having six equal sides and being a sliding fit on said shaft;

said outside being hexagonal in shape and having three large sides and three small sides;

said large sides alternating with said small sides.

* * * * *